US006584296B1

(12) United States Patent
Swift

(10) Patent No.: US 6,584,296 B1
(45) Date of Patent: Jun. 24, 2003

(54) ELECTRO-MECHANICAL ROLL WITH CORE AND SEGMENTS

(75) Inventor: Joseph A. Swift, Ontario, NY (US)

(73) Assignee: Xerox Corporation, Stamford, CT (US)

( * ) Notice: Subject to any disclaimer, the term of this patent is extended or adjusted under 35 U.S.C. 154(b) by 14 days.

(21) Appl. No.: 09/997,178

(22) Filed: Nov. 30, 2001

(51) Int. Cl.[7] ..... G03G 15/16; G03G 15/02; G03G 21/00

(52) U.S. Cl. ..... 399/313; 399/176; 399/357; 492/39; 492/40

(58) Field of Search ..... 399/174, 176, 399/286, 279, 313, 318, 357; 492/38, 39, 40

(56) References Cited

U.S. PATENT DOCUMENTS 691,011 A * 1/1902 Sheehan ..... 492/40
696,416 A * 4/1902 Denegre ..... 492/40
2,404,159 A * 7/1946 Barber ..... 492/38
2,807,233 A 9/1957 Fitch
2,836,725 A 5/1958 Vyverberg
3,043,684 A 7/1962 Mayer
3,267,840 A 8/1966 Honma et al.
3,328,193 A 6/1967 Oliphant et al.
3,525,146 A 8/1970 Hayashida et al.
3,598,580 A 8/1971 Baltazzi et al.
3,630,591 A 12/1971 Eastman
3,684,364 A 8/1972 Schmidlin
3,691,992 A 9/1972 Beemer
3,702,482 A 11/1972 Dolcimascolo et al.
3,782,205 A 1/1974 Fletcher et al.
3,796,423 A * 3/1974 Shuster ..... 492/40
3,812,782 A * 5/1974 Funahashi ..... 492/40
3,832,055 A 8/1974 Hamaker
3,847,260 A * 11/1974 Fowler ..... 492/40
3,847,478 A 11/1974 Young
3,866,572 A 2/1975 Gundlach
3,924,943 A 12/1975 Fletcher
3,959,573 A 5/1976 Eddy et al.
3,959,574 A 5/1976 Seanor et al.
3,966,199 A 6/1976 Silverberg
4,010,528 A * 3/1977 Bohmer ..... 492/40
4,116,894 A 9/1978 Lentz et al.
4,309,803 A 1/1982 Blaszak
4,352,230 A * 10/1982 Sukenik ..... 492/40
4,379,630 A * 4/1983 Suzuki ..... 399/313
4,397,072 A * 8/1983 Otthofer, Jr. ..... 492/40
4,974,782 A * 12/1990 Nelson ..... 492/39
5,075,731 A * 12/1991 Kamimura et al. ..... 399/313
5,321,476 A 6/1994 Gross
5,742,880 A * 4/1998 Takenaka et al. ..... 399/176
5,744,238 A * 4/1998 Limperis et al. ..... 492/38
5,849,399 A 12/1998 Law et al.
5,893,821 A * 4/1999 Ando et al. ..... 492/39
5,897,248 A 4/1999 Schlueter, Jr. et al.
5,970,297 A 10/1999 Gross
6,173,149 B1 * 1/2001 Kim ..... 399/313
6,280,371 B1 * 8/2001 Krippelz ..... 492/39
6,471,625 B1 * 10/2002 Jimenez ..... 492/40
2002/0159803 A1 * 10/2002 Jader ..... 399/313

* cited by examiner

*Primary Examiner*—Susan S. Y. Lee
(74) *Attorney, Agent, or Firm*—Andrew D. Ryan

(57) ABSTRACT

An electro-mechanical roll such as a bias transfer roll for use in a printing or copying apparatus comprising a conductive core having a segmented layer of compressible material positioned in a tandem relation to another thereon to form a generally cylindrical roll member.

22 Claims, 4 Drawing Sheets

ELECTRO-MECHANICAL ROLL WITH CORE AND SEGMENTS

BACKGROUND OF THE INVENTION

The present invention relates generally to an apparatus for transferring of charged toner particles in an electrostatographic printing machine, and more particularly, to an electro-mechanical roll such as a bias transfer roll including a plurality of compressible segments positioned in a tandem relation on an electrically conductive core.

Reference is made to co-pending application, Ser. No. 09/996,819 entitled, Method of Making an Electro-Mechanical Roll, Docket No. D/99132Q, filed concurrently herewith, and the disclosure of which is totally incorporated herein by reference.

While existing electro-mechanical rolls are generally suitable, improvements in development quality and manufacturing efficiency are desired. Therefore, a cost-effective electro-mechanical roll of suitable lengths is beneficial.

Examples of electro-mechanical rolls such as bias transfer roll and systems can be found in U.S. Pat. Nos. 2,807,233; 2,836,725; 3,043,684; 3,267,840; 3,328,193; 3,598,580; 3,525,146; 3,630,591, 3,684,364; 3,691,992; 3,702,482; 3,782,205; 3,832,055; 3,847,478; 3,866,572; 3,924,943; 3,959,573; 3,959,574; 3,966,199; 4,116,894; 4,309,803; 5,321,476; 5,849,399; 5,897,248, and 5,970,297.

All documents cited herein, including the foregoing, are incorporated herein in their entireties for all purposes.

SUMMARY OF THE INVENTION

In one aspect, an electro-mechanical roll is provided, comprising an electrically conductive core and a series of tube shaped members positioned in a tandem relationship to another and surrounding the electrically conductive core.

In another aspect, an electrostatographic apparatus includes an electro-mechanical roll having more than one, for example, from two to twenty four, tube-shaped segments positioned in a tandem relation to one another on an electrically conductive core.

In yet another aspect, an electro-mechanical roll for use in printing and copying machines may have a length ranging from 8 to 120 inches and an outside diameter ranging from 0.25 inches to 48 inches. The roll may be made by using a plurality of molded or extruded, tube-shaped segments positioned in a tandem relation to one another on an electrically conductive core. Each tube-shaped segment may have a length, for example, up to about 50% of the overall length of the roll.

In a further aspect, an electro-mechanical roll includes an electrically conductive core having a length and an outside surface. A plurality of conformable members are disposed coaxially over a portion of the outside surface of the electrically conductive core, each of the plurality of conformable members have a length. The plurality of members are positioned in tandem relationship to one another over the outside surface of the electrically conductive core.

In another aspect, a bias transfer roll includes an electrically conductive core having a length ranging from about 8 inches to about 120 inches and an outside surface. A plurality of conformable tube-shaped segments are disposed coaxially over a portion of the outside surface of the electrically conductive core and positioned in tandem relationship to one another along the outside surface of the electrically conductive core. Each of the tube-shaped segments have a length of at least 0.5 inches. An overcoat layer is disposed on the plurality of conformable tube-shaped segments.

In yet another aspect, a xerographic apparatus includes a development unit; and an electro-mechanical roll. The electro-mechanical roll including a stainless steel electrically conductive core having a length ranging from 8 inches to 120 inches and an outside surface. A plurality of tube-shaped segments are disposed coaxially over at least a portion of the outside surface of the stainless steel electrically conductive core. The tube-shaped segments are positioned in tandem relationship to one another along the outside surface of the electrically conductive core. Each of the tube-shaped segments includes a polymer organ elastomer and has a length ranging from 0.5 inches to 12 inches. An overcoat layer is disposed on the tube-shaped segments. The xerographic apparatus is adapted for copying and/or printing.

Still other aspects and advantages of the present invention and methods of construction of the same will become readily apparent to those skilled in the art from the following detailed description, wherein only the preferred embodiments are shown and described, simply by way of illustration of the best mode contemplated of carrying out the invention. As will be realized, the invention is capable of other and different embodiments and methods of construction, and its several details are capable of modification in various obvious respects, all without departing from the invention. Accordingly, the drawing and description are to be regarded as illustrative in nature, and not as restrictive.

DETAILED DESCRIPTION OF THE INVENTION

While the principles and embodiments of the present invention will be described in connection with an electro-mechanical roll, electrostatographic apparatus, xerographic apparatus, printing and/or copying machine, it should be understood that the present invention is not limited to that embodiment or to that application. The invention is also suitable for use as a heated or cooled biased transfer roll, biased charging roll, decurler roll, paper handling roll, compliant foam or rubber cleaning roll, or any other roll-type component serving as both an electrical as well as a mechanical rolling member. Therefore, it should be understood that the principles of the present invention and embodiments extend to all alternatives, modifications, and equivalents thereof.

Figure 1:
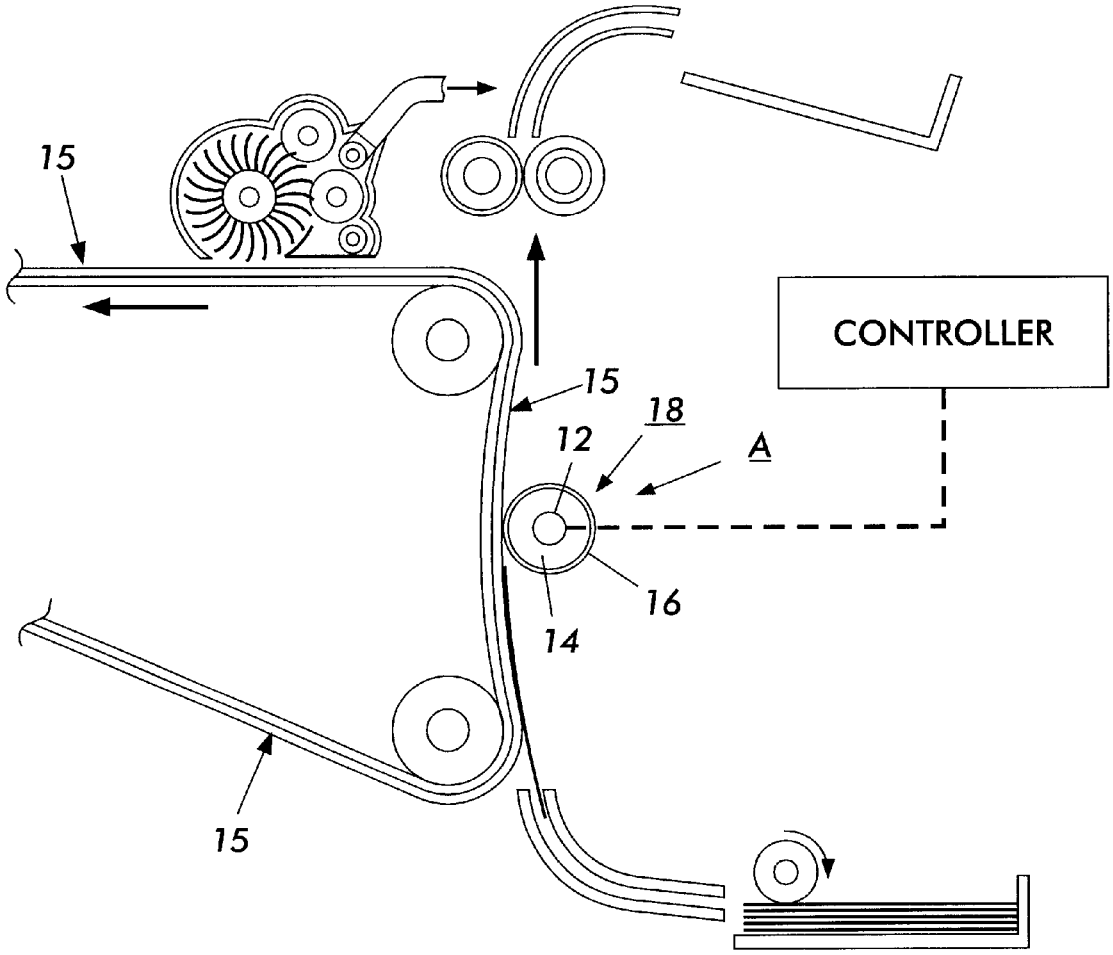
FIG. 1 is a schematic elevational view showing a portion of a printing or copying machine including an electro-mechanical roll such as a bias transfer roll.

Turning to FIG. 1, illustrated is an embodiment of an electro-mechanical roll such as a bias transfer roll 18 that serves as a transfer support member at transfer station A of a electrostatographic printing and/or copying machine. The bias transfer roll 18 enables transfer of the developed toner image from the image bearing photoconductive surface 15 to a copy sheet or support substrate and provides support to the copy sheet between the bias transfer roll and the photoconductive member during the transfer process.

Figure 2:
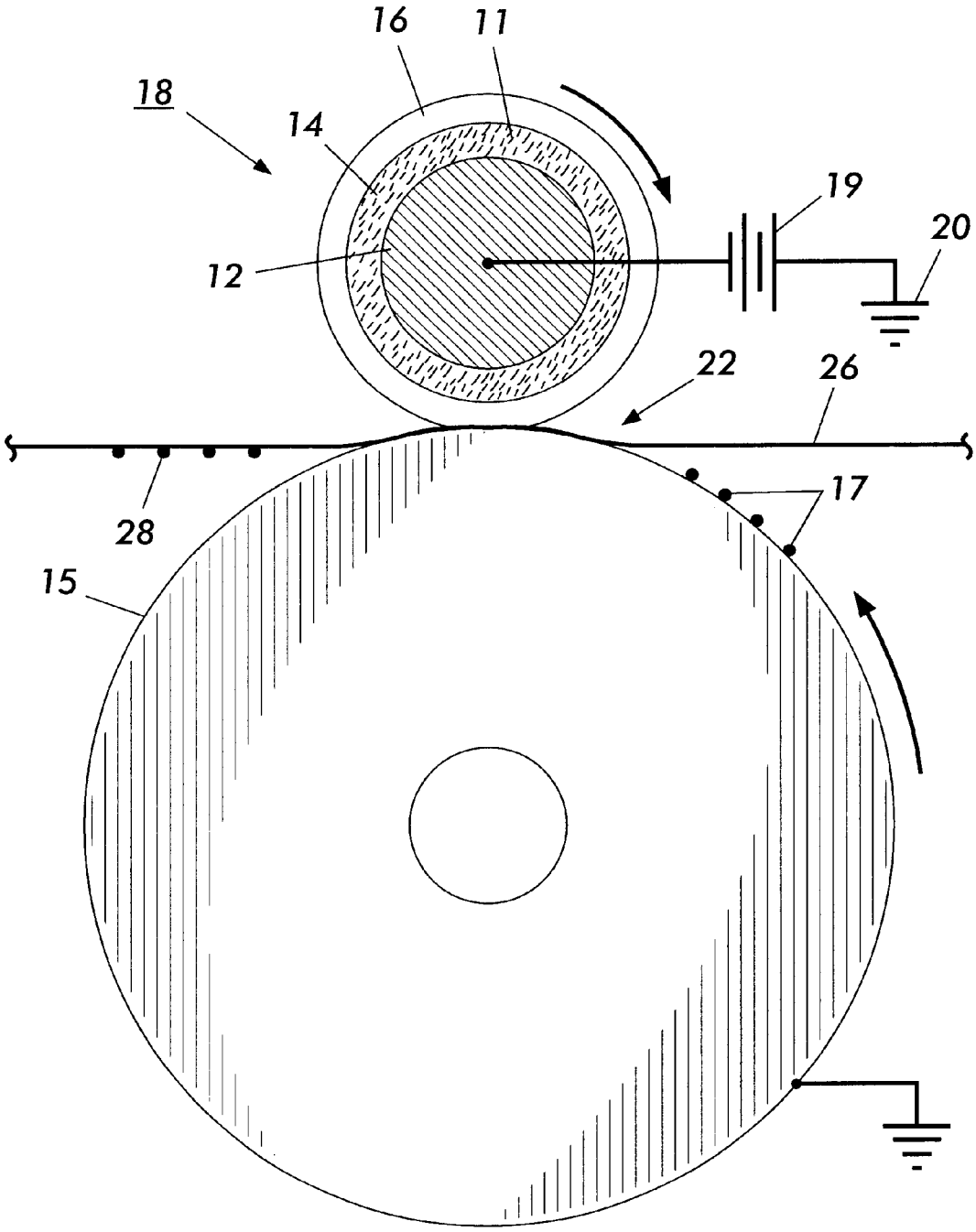
FIG. 2 is a perspective view in partial section showing the construction of an embodiment of an electro-mechanical roll such as a bias transfer roll.

Referring to FIG. 2, an embodiment of an electro-mechanical roll such as a conformable bias transfer roll member 18 is shown in the configuration of a transfer system of an embodiment of an electrostatographic printing and/or copying machine. A drum-type photoconductive insulating surface 15 is shown in operative engagement with the conformable bias transfer roll 18, forming a nip 22 therebetween. An electrical biasing source 19 such as a DC voltage source is coupled to ground 20 and to the conductive core 12 for applying a bias potential to the bias transfer roll 18 to create transfer fields in the transfer nip 22 and to induce the transfer of charged toner particles from the photoconductive surface toward the bias transfer roll 18.

The bias transfer roll 18 is subjected to a compressive force in the nip 22 formed in the area of contact between the roll 18 and the photoconductive surface 15. This compressive force causes the compression of the roll 18 such that the conductive core 12 of the roll 18 is brought into closer proximity to the photoconductive surface 15, upon which the powder toner image is located. For example, the spacing from the roll 18 to the photoconductive surface 15 may range from about zero up to about 50% of the thickness of the layer 14.

A powder toner image 17 previously formed and developed in accordance with the electrostatographic process is present on the surface 15 of the photoconductive insulating drum. A copy sheet 26 or other support substrate travels through the nip 22 formed in the area of contact between the bias transfer roll 18 and the photoconductive insulating surface 15 for receiving the powder toner image 17. Thus, the powder toner image is transferred to the support sheet 26, appearing as a transferred image 28 thereon, by operation of the bias transfer roll 18.

The bias transfer roll 18 is generally cylindrical and comprises a layer of compressible material disposed on the conductive core 12. The layer may be formed from tube shaped segments 14 positioned in a tandem relationship to another along the length of the core 12 in a coaxial manner. The segments 14 may be comprised of a polyurethane, a silicone, an epichlorohydrin (EPDM) formulation or any other substantially resistive, electrically relaxable material capable of providing desirable resistivity and compressibility characteristics. This formulation may be closed cell or open cell, i.e., any foam material, which is sufficiently compressible. The segments 14 may be made of an elastomer, such as a silicone or urethane material, or combinations thereof. The segments 14 may be made of a rubber material selected to have a suitable durometer, or hardness, that can range from very soft, soft, medium, hard, or very hard depending upon the characteristics of the desired nip and whether the roll 18 is to be heated. The segments 14 may provide a springback characteristic that is rubbery and spongy and is generally able to return to its non-deformed state upon exiting the contact region with the photoreceptor surface 15. The segments 14 may have a hardness of less than 90 Shore A, generally from about 5 to about 60 Shore A.

The segments 14 may include a conductive filler 11, particles or other suitable material dispersed throughout including, for example, carbon black particles, carbon fibers, metal particles, metal fibers, alumina metal powders or flakes, graphite filings, particles of any other satisfactory conductive material in any suitable shape or size, or combinations thereof, coated particles or fibers where either the coating, or particle, or both are suitably conductive, ionic salts, ionic salt modified polymers known as ionomers, or combinations thereof. Fillers 11 may be used to produce desired electrical properties such that a portion of the roll 18 that dynamically forms the transfer nip can temporarily act as an electrical conductor and generally act as an insulator elsewhere. This behavior, where the voltage applied to the conductive core 12 is allowed to move regionally and radially outwards across the segments 14, is referred to as electrical relaxation where the bias conducts across the segments 14 that is in, or close to, the nip region and the segments 14 remains effectively insulating everywhere else.

In addition, one or more peripheral surface coating(s) 16 may also be provided over and along the circumferential exterior surface of the segments 14. The coating 16 may be sufficiently elastic and resilient to yield to the compressible characteristics of the conformable underlying segments 14. Alternatively, the coating 16 may be harder and more durable than the segments 14 to add durability, puncture resistance, wear or dirt resistance, or improve some other desired feature such as friction or clean-ability. Coating 16 is optional and may be provided for sealing and insulative properties as required for operation of the transfer system. Optionally, one, or more of the fillers identified above may be included in the composition of the coating 16 at the same or different loading levels as required by the application. For example, if a more insulative coating 16 is desired, the filler loading level will generally be less than for the more conductive layer 14. Other fillers 11 may be added to this coating 16 to achieve other desired effects. For example, teflon™ particles may be added to reduce friction of an outermost coating 16.

The coating 16 may include or contain an electrically conductive fluorinated carbon filled fluoroelastomer, or other suitable fluoroelastomer, urethane, or similarly suitable material. The coating 16 may be used to control the resistivity of the bias transfer roll 18. In addition, the sensitivity of the resistivity may also be controlled in relationship to changes in relative humidity, temperature, corona exposure, corrosive environment, solvent treatment, contamination, cycling to high electric fields and running time. The coating 16 may advantageously improve the surface finish and mechanical properties of the roll 18. The coating 16 may be selected and used to improve abrasion and wear resistance, to prevent contamination, and as a material to provide a smooth surface finish, selected surface finish, and selected properties, such as friction. Coating 16 may include combinations of coating layers used for different purposes, for example, one layer to prevent contamination and one layer to modify friction properties.

Figure 3:
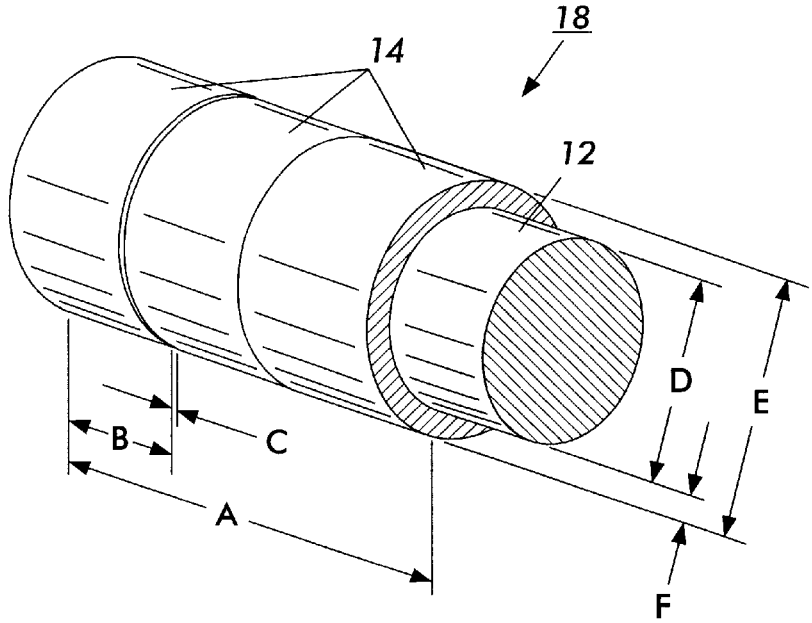
FIG. 3 is a perspective view in partial section showing the construction of an embodiment of an electro-mechanical roll such as a bias transfer roll.

Referring now to FIG. 3, there is shown a perspective cut-away view of an embodiment of an electro-mechanical roll 18 illustrating the construction thereof. The roll 18 may be formed upon a solid, rigid cylinder 12 that is fabricated of a conductive metal, such as aluminum, copper, stainless steel, steel, brass, or, conductive plastic, carbon filled nylon, and pultruded conductive carbon filled plastic or the like, capable of maintaining rigidity, structural integrity and capable of readily responding to a biasing potential placed thereon. The conductive core 12 may optionally be tubular and hollow. The conductive core 12 may optionally have a surface finish of less than 64 microinches.

In embodiments, the electro-mechanical roll 18 may include: the overall length, dimension A ranging from 8 inches to 120 inches, generally from about 12 inches to about 36 inches; dimension B of individual tube shaped segments ranging from 0.5 inch to 18 inches, generally from about 3 inches to about 12 inches; dimension C of gaps between individual tube shaped segments ranging from 0 inches to 0.3 inches, generally from about 0 inches to about 0.10 inches; dimension D, the core outer diameter ranging from 0.2 inches to 47 inches, generally from about 0.375 inches to about 11 inches; dimension E diameter ranging from 0.50 inch to 48 inches, generally from about 0.625 inches to about 12 inches; dimension F, the thickness of the compressible layer(s) ranging from 0.004 inches to 4.0 inches, generally from about 0.2 inches to about 0.75 inches. The electro-mechanical roll 18 may include multiple layers of segments 14 or multiple layers of coatings 16 on top of another or alternating combinations thereof. The segments 14 may be in contact with one or more other segments 14. The total number of segments 14 in one layer or in one plane may range from 2 to 24.

The segments 14 may be positioned on the core 12 to form a butting interface between adjacent ends of adjoining segments 14 and in such a manner to sustain a minimum compression force sufficient to resist the lateral deformation forces of the nip formed in the apparatus. The segments 14 may also be positioned such that they form a gap between one another. The lengths of the segments 14 may be equal or they can vary in length over the roll 18. The thickness of the segments 14 may be equal or they can vary over the length of the roll 18. A variation in thickness may require grinding of the exterior surface of the roll 18 to a desired contour or profile, a thickness which may be continuous and gradual or stepwise. The exterior surface of the segments 14 may be coated to provide certain performance characteristics and acceptable transfer and print quality. The exterior surface of the segments 14 or coating 16 may be ground to a smooth surface, to the same size, to a certain pattern, to a certain profile such as concave, convex, sinusoidal. The profile of the electro-mechanical roll 18 may be designed for selected paper drive or registration purposes.

The segments 14 may be placed on the core 12 using a lubricant, such as water or alcohol, but are generally placed on a clean interface to form a suitable electrical interface. Optionally, the segments 14 may be thermally, frictionally or chemically disposed on the electrically conductive core 12 by using an adhesive, solvent welding, and the like. Friction between internal surfaces of the layer 14 and core 12 may be sufficient for fastening purposes as an exterior surface of the core 12 or interior surface of the segments 14 may be sufficiently rough to prevent movement between the core 12 and the segments 14. An adhesive layer may be used to adhere the segments 14 to the core 12 and may be selected from, for example, epoxy resins, polyurethanes, and polysiloxanes, or blends or copolymers thereof. Adhesives may include materials such as THIXON 403/404, Union Carbide A-1100, Dow TACTIX 740, Dow TACTIX 741, and Dow TACTIX 742. A curative for the adhesives may include Dow H41.

Figure 4:
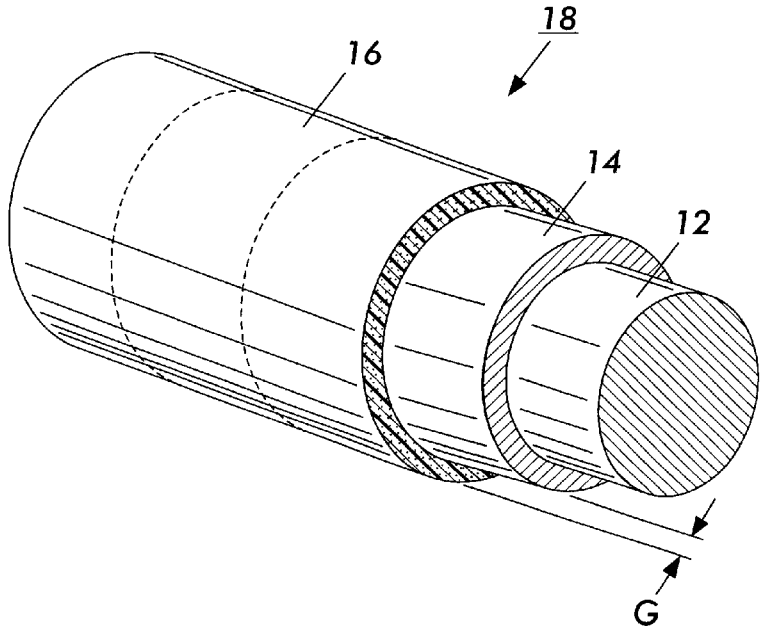
FIG. 4 is a perspective view in partial section showing the construction of an embodiment of an electro-mechanical roll such as a bias transfer roll including a coating thereon.
Figure 5:
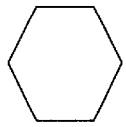
FIGS. 5–9 are cross-sectional views of various embodiments of a non-circular electrically conductive core of an electro-mechanical roll.
Figure 6:
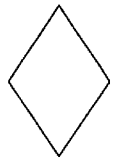
Figure 7:
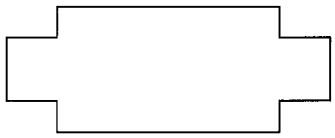
Figure 8:
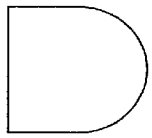
Figure 9:
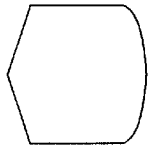

FIG. 4 illustrates an embodiment of an electro-mechanical roll 18 having segments 14 positioned between the conductive core 12 and a coating 16. In embodiments, the thickness of the coating 16, dimension G, may range from 0.00001 inches to 0.75 inches, generally from about 0.001 inches to 0.16 inches.

In embodiments, resistivity ranges may vary for transfer systems designed to operate at different transfer sheet throughput speeds and is selected to correspond to the roller surface speed and nip region dimension such that the time necessary to transmit the bias from the conductive core to the external surface of the bias system member is roughly equal to, or less than the dwell time for any point on the bias system member in the transfer nip region. It has been found that a resistivity of the outer layer of between $10^4$ and $10^{14}$ ohm-cm, generally from $10^4$ to about $10^{12}$, and generally from about $10^8$ to about $10^{10}$ ohm-cm is sufficient for this requirement if there is no intermediate layer positioned between the outer resistive layer and the substrate. If, however, there is an intermediate layer positioned between the substrate and the outer resistive layer, the resistivity may be from $10^5$ to $10^{12}$ ohm-cm and generally from about $10^7$ to about $10^{11}$ ohm-cm.

By precisely cutting lengths of the segments 14, positioning them on the electrically conductive core 12, and then optionally gluing them in place, optionally applying compression, optionally grinding, and optionally applying coating thereon provides a low cost, easy-to-manufacture, electro-mechanical roll 18 such as a bias transfer roll having a desired length, contour and finish. Ends of the segments 14 may be positioned and joined together such that under compression, the existence of seams are not visible in the resulting print. The print quality of images transferred across such seam regions as well as the durability of the seams during exposure to the nip dynamics is generally good. Alternatively, the presence of a moderate gap between the ends of the segments 14 allows the roll 18 to function satisfactorily and provide generally good print quality.

In embodiments, an electro-mechanical roll such as a bias transfer roll may be produced, for example, by: (1) providing lengths of foam composition in an appropriate size tube form; (2) cutting the foam tubes to precise end regions, for example, perpendicular, zig-zag, angular, bullet shape, conical, or various patterns suitable for interlocking or adjoining to adjacent tubes; (3) providing an electrically conductive core member such as a metal tube or shaft; (4) applying an adhesive layer to the core member; (5) applying the foam tubes to the core member; (5) butting the lengths of foam composition together; (6) applying compression of at least 1 gram/sq. mm to the entire periphery of lengths of foam composition; (7) allowing the adhesive to set and/or cure while maintaining the compressive force; (8) grinding the roll circumference to appropriate dimension; (9) applying an overcoat layer; and (10) allowing the overcoat layer to dry. The molding process may include shot foaming and curing in a mold.

Such a manufacturing process advantageously provides increased flexibility in production of electro-mechanical rolls of various lengths with generally no upper limit of length. For example, it is possible to produce rolls with lengths of many hundreds of feet, or even miles. In addition, such manufacturing process advantageously provides a system for simultaneously testing the suitability of various materials. Moreover, the electro-mechanical roll and method of manufacturing described advantageously overcomes the limitations of, for example, short time required for acceptable foaming and curing balanced against the time and pressures it takes to fill the mold cavity in conventional manufacturing processes. For example, when the volume of the cavity is relatively small and the ratio of cavity length to cross sectional area is large, the time to fill it via injection molding must be within the acceptable parameters of foam formation and crosslinking completion. However, once the ratio of length-to-area exceeds a critical value, which may occur with long thin walled parts, the versatile and low cost molding/foaming process is generally no longer viable. Moreover, the increased mold-fill time associated with such molds along with certain foam formulations, may cause premature curing which then interrupts the mold filling process. In addition, the high pressures required for rapid filling of the long, thin cavity acts as a back pressure to the foaming process and foam formation may be impeded. Therefore, desired pore size, quality, and foam density may not be obtainable other than for a limited range of cavity geometries. An alternative manufacturing process of extrusion often does not yield the same range of desirable properties for material of a bias transfer roll. Thus, while extrusion may be a viable process to create the larger length material in one-piece for the electro-mechanical roll, the uniformity of critical properties driving functionality such as electrical conductivity and durometer, may not be acceptable over very long extrusion runs.

In embodiments, as illustrated in FIGS. 5–9, the cross-sectional shape of the core 12 may include a variety of non-circular shapes. For example, the cross-section of the core 12 may be non-circular, and the inside shape of the segments 14 may be non-circular, while the outside surface of the segments 14 may be generally circular. The segments 14 may be slip fit onto the core 12 with the orientation of the non-circular features of the core 12 aligned with the similar non-circular features of the segments 14. This shape-matching process enables the segments 14 to be mounted onto the core 12 and assures non-slip mounting. Alternatively, suitable non-circular geometric shapes of cores 12 and inside shapes of segments 14 are envisioned, for example, rectangles, squares, triangles, ovals, and the like, or combinations thereof.

In an embodiment, each segment 14 can be formed of a different material and then be positioned on the electrically conductive core 12 and used for component development and material selection purposes. For example, an 8 inch to 14 inch electro-mechanical roll 18 such as a bias transfer roll having an outside diameter up to 2 inches may include tubular shaped segments 14, each segment ranging from 0.5 inch to 2 inches wide, positioned in a tandem relation to another on the conductive core 12. The ability to incorporate a variety of materials in the form of segments 14 on the core 12 provides an efficient testing system to differentiate performance of various materials during a single transfer experiment. Using such a system for testing various materials can help build statistics into experimentation with different materials without the need for a large number of costly, time consuming, repetitive trials.

Such electro-mechanical rolls and methods of making the same advantageously overcome various limitations and provide generally low development and production costs, and generally high quality rolls.

While this invention has been described in conjunction with various embodiments, it is evident that many alternatives, modifications, and variations thereof will be apparent to those skilled in the art. Accordingly, it is intended to embrace all such alternatives, modifications, and variations and their equivalents.

What is claimed:

1. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length and a thickness ranging from 0.004 inches to 4.0 inches;

wherein the plurality of members are positioned in tandem relationship to one another over the outside surface of the electrically conductive core and include a coating on the plurality of members.

2. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core and further including a coating over the plurality of conformable members.

3. The electro-mechanical roll of claim 2, wherein the plurality of conformable members comprise tube-shaped segments.

4. The electro-mechanical roll of claim 3, wherein the tube-shaped segments are each a molded piece.

5. The electro-mechanical roll of claim 3, wherein the total number of tube shaped segments in one layer ranges from 2 to 24.

6. The electro-mechanical roll of claim 3, the electro-mechanical roller is at least one of a bias transfer roll, bias charging roll, decurling roll, cleaning roll, and paper handling roll.

7. The electro-mechanical roll of claim 2, wherein at least two of the members comprises different materials.

8. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core and wherein one of the conformable members is spaced apart from the another conformable member a distance ranging from 0.0001 inches to 0.3 inches.

9. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core and wherein the plurality of members each have a thickness ranging from 0.004 inches to 4.0 inches.

10. The electro-mechanical roll of claim 9, wherein at least two of the members are in contact with each other.

11. The electro-mechanical roll of claim 9, wherein the plurality of members comprise a polymer.

12. The electro-mechanical roll of claim 9, wherein the plurality of members comprise an elastomer.

13. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core, wherein the plurality of conformable members comprise tube-shaped segments and wherein each tube-shaped segment has a length ranging from 0.5 inches to 18 inches.

14. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core, wherein the plurality of conformable members comprise tube-shaped segments and wherein the inside shape of the member is non-round and the outside shape of the conductive core is non-round.

15. The electro-mechanical roll of claim 14, wherein the inside shape of the member is selected from at least one of rectangular, square, triangle, and oval.

16. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core, wherein at least two of the members are in contact with each other and wherein the two members in contact with one another provide a compression force to the other.

17. An electro-mechanical roll for an electrostatographic machine comprising:

an electrically conductive core having a length and an outside surface; and a plurality of conformable members disposed coaxially over a portion of the outside surface of the electrically conductive core, each of the plurality of members having a length;

wherein the plurality of members are positioned in tandem relationship to one another over the outside surface of the electrically conductive core, wherein the plurality of conformable members comprise tube-shaped segments and wherein the plurality of members comprises at least one of a foam material and a rubber material.

18. A bias transfer roll, comprising:

an electrically conductive core having a length ranging from 8 inches to 120 inches and an outside surface;

a plurality of conformable tube-shaped segments disposed coaxially over a portion of the outside surface of the electrically conductive core and positioned in tandem relationship to one another along the outside surface of the electrically conductive core, each of the tube-shaped segments having a length of at least 0.5 inches; and a coating disposed on the plurality of conformable tube-shaped segments.

19. The bias transfer roll of claim 18, wherein the tube-shaped segments are adhesively adhered upon the electrically conductive core.

20. The bias transfer roll of claim 18, wherein the tube-shaped segments withstand a compression force sufficient to resist a lateral deformation force.

21. The bias transfer roll of claim 18, wherein each of the plurality of tube-shaped segments are spaced tandemly apart from one another along one plane.

22. A xerographic apparatus comprising:

a development unit; and a electro-mechanical roller including a stainless steel electrically conductive core having a length ranging from 8 inches to 120 inches and an outside surface; and a plurality of tube-shaped segments disposed coaxially over at least a portion of the outside surface of the stainless steel electrically conductive core, the plurality of tube-shaped segments positioned in tandem relationship to one another along the outside surface of the electrically conductive core, each of the tube-shaped segments comprising at least one of a polymer and an elastomer and having a length ranging from 0.5 inches to 18 inches; and an overcoat layer disposed on the tube-shaped segments;

wherein the xerographic apparatus is adapted for at least one of copying and printing.

* * * * *